United States Patent [19]

Belt

[11] 4,149,351

[45] Apr. 17, 1979

[54] BUILDING STRUCTURE PRODUCED USING FIBERGLASS FORMS

[76] Inventor: James R. Belt, 18912 Silver Maple, Santa Ana, Calif. 92705

[21] Appl. No.: 826,387

[22] Filed: Aug. 22, 1977

[51] Int. Cl.[2] ..... E04B 1/16

[52] U.S. Cl. ..... 52/741; 264/32

[58] Field of Search ..... 52/741, 80, 82; 264/32, 264/33, 36

[56] References Cited

U.S. PATENT DOCUMENTS

| | | | |
|---|---|---|---|
| 2,324,911 | 7/1943 | Corbetta | 264/32 |
| 3,462,521 | 8/1969 | Bini | 264/32 |
| 4,011,705 | 3/1977 | Vanderklaauw | 264/32 |

FOREIGN PATENT DOCUMENTS

| | | | |
|---|---|---|---|
| 236287 | 5/1959 | Australia | 52/82 |
| 1306223 | 2/1973 | United Kingdom | 52/741 |

*Primary Examiner*—John E. Murtagh
*Attorney, Agent, or Firm*—Willie Krawitz

[57] ABSTRACT

A house, building, or the like having an ellipsoid roof and integral, circular sidewall, is produced using a plurality of reinforced forms. Each form has elongate, positively curved, triangular sides defining an apex, and an upwardly inclined, sidewall portion. Fiberglass forms are preferred and they may be tightened together by bolts or interlocked along their edges. Each form at its apex is supported by a centerpost while the sidewall is supported by an outer foundation.

The structure is formed by blowing foam or gas concrete in place onto the reinforced forms, and when the concrete has cured and hardened, the forms are removed and may be reused. The invention eliminates the need for heavy bar or rod reinforcement usually employed for ellipsoid or hemisphere domes and requires only a wire mesh reinforcement.

6 Claims, 6 Drawing Figures

BUILDING STRUCTURE PRODUCED USING FIBERGLASS FORMS

BACKGROUND OF THE INVENTION

This invention relates to a new and improved building form and to a house, building or the like which is constructed thereon.

The use of lightweight concrete for a dome-shaped or rectangular type structure is well known and many designs have, in the past, been proposed. Heretofore, the use of concrete in buildings has tended to be limited to structures that are naturally self supporting such as rectangular shaped houses, or which are supported by pillars, or which are heavily reinforced such as spherical or ellipsoid domes, etc.

Also, as a general rule, some type of equipment is usually necessary in order to erect a concrete element in place, and this in turn adds to the expense of the structure. Where a house or structure has a hemispheric shape or high ceiling, heating is difficult since warm air tends to stratify near the ceiling. An air recirculation system could overcome this problem, but is expensive and also consumes energy.

In the past, some types of concrete structures have been formed by various techniques such as by erection in segments, by gas blowing, etc; typical techniques are described in U.S. Pat. Nos. 3,462,521 and 3,619,432. However, in the case of blowing, the entire operation is cumbersome and requires special equipment. The technique of erecting a concrete structure in segments usually necessitates the use of reinforcement bars in the segment to prevent it from cracking. This is disclosed in the text, "DESIGN OF THIN CONCRETE SHELLS," by A. M. HAAS (John Wiley & Sons), 1962, Vol. 1, page 119 (photograph).

A need exists for houses having good thermal insulation which are easy and inexpensive to install and which have good resistance to wind. Also, the houses should employ low cost materials that are long lasting and provide an aesthetic appearance which avoids a housing tract look.

THE INVENTION

According to the invention, a lightweight concrete structure such as a house, building, or the like is provided in which the concrete is applied onto a plurality of specially configured removeable forms and cured in place; after the structure has cured and hardened, the forms are removed. The structure which is produced has a circular base and a low profile, ellipsoid dome or roof. Few workers are required to install the forms and apply the cement (usually by blowing) and a minimum of equipment on site is necessary. The structure provides good wind resistance because of its low profile and circular, streamline shape; when employing foam or gas concrete, good thermal insulation is obtained and improved buckling resistance is achieved because the dead weight load is decreased.

Each form is configured to provide a positively curved upper portion having an elongate, triangular shape defining an apex and a base; a lower portion of the form, integral with the base, is positively curved and quadrilateral in shape. The upper portion of each form at the apex is supported by a centerpost while the lower, quadrilateral portion is supported by a circular foundation. When the forms are set up to-gether, they form a positively curved, ellipsoid dome and a continuous sidewall.

Typically, the dome or roof portion of the structure has a radius of about 15–25 feet from the base of the triangle to the centerpost when measured in the horizontal plane under the dome. The dome height varies from about 7–10 feet at its periphery and 10–13 feet at the centerpost; preferably, about a 3 foot height differential is maintained between the dome periphery and the centerpost. The dome has an overall slope from base to centerpost of about 0.1–0.25. For a centerpost height of about 10–13 feet, and a radius of about 15–25 feet, the aspect ratio (radius/height) varies from about 1.15–2.5. The sidewall width of a form is about 6–10 feet and usually, 16–26 forms are generally employed in a structure of the size indicated.

Normally, the use of an ellipsoid curved roof having an aspect ratio of about 1.5–2.5 would present a buckling danger since the upper portion is relatively flat and tends to behave as a plate. The solution heretofore has been to revert to a hemisphere shaped, reinforced roof or to prestress the ellipsoid. See for example the test, "DESIGN OF THIN CONCRETE SHELLS," supra, pages 40–42. However, reinforcement with both bars and wires is expensive and time consuming to install. By employing a lightweight wire reinforcement and lightweight concrete in conjunction with a centerpost support, an aesthetically pleasing departure can be made from a hemisphere shape while at the same time minimizing buckling problems.

Placement of a wire mesh over the forms while the concrete is blown on enables a uniform coat to be applied. When in place, the wire mesh functions as a replacement for the heavy reinforcement bars normally employed in thin shell roof structures.

Together with its low streamline profile and insulating properties, reasonably even temperature levels can be maintained within the structure and this lends itself to use in desert areas where extreme conditions of temperature and strong winds are prevalent.

DESCRIPTION OF THE PREFERRED EMBODIMENTS

Figure 1:
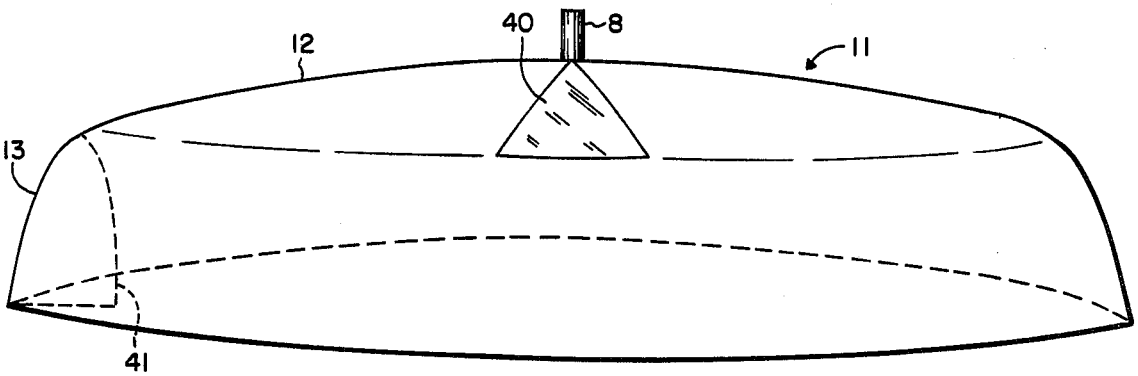
FIG. 1 is an external perspective view showing a structure according to the invention made using the forms of this invention.
Figure 2:
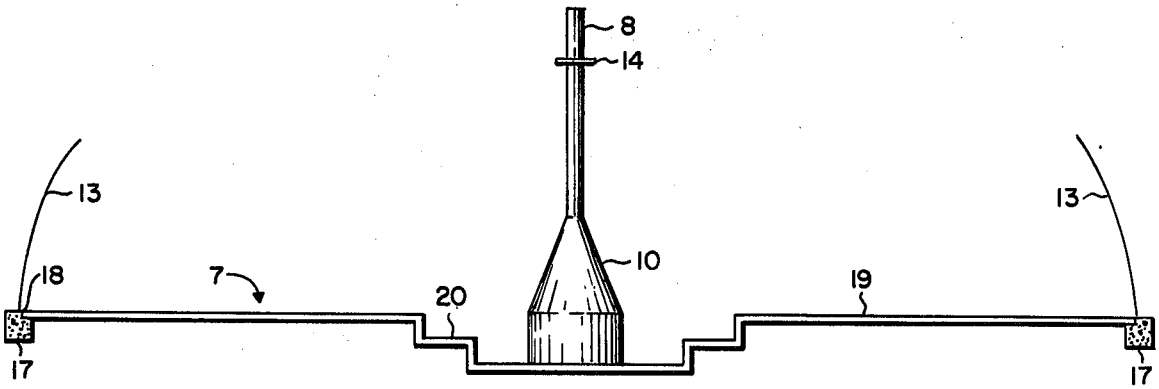
FIG. 2 shows the foundation and centerpost for the forms.
Figure 3:
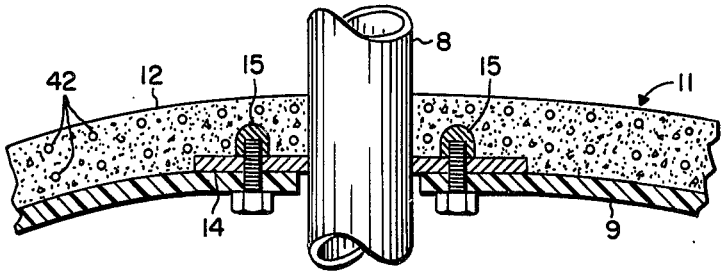
FIG. 3 shows details of the centerpost support for the forms and applied concrete.

The structure of this invention is shown in FIGS. 1 and 2 and includes a foundation 7 and a hollow, centerpost 8 which, at its upper end, functions to support the ends of cement support forms 9; at its lower end, the centerpost can also function as a fireplace 10. A plurality of the forms 9 are combined to form a support for a cement structure 11 as it is being applied and cured. The structure itself defines an ellipsoid dome 12 and a round, sidewall portion 13. A metal collar 14 extends around the centerpost 8 at its upper end and is attached thereto. The collar is provided with a series of sleeves 15 onto which the forms are bolted during the course of construction as shown in FIG. 3.

The foundation 7 includes an external, peripheral portion 17 of suitable thickness (e.g. 12 inches×15 inches) for supporting the sidewall portion 13 in a groove 18 therein. The foundation also provides a thinner (e.g. about 3–6 inches) interior cap 19 as a support in the living quarters area. A step-down area 20 is provided at the base of the fireplace.

Figure 4:
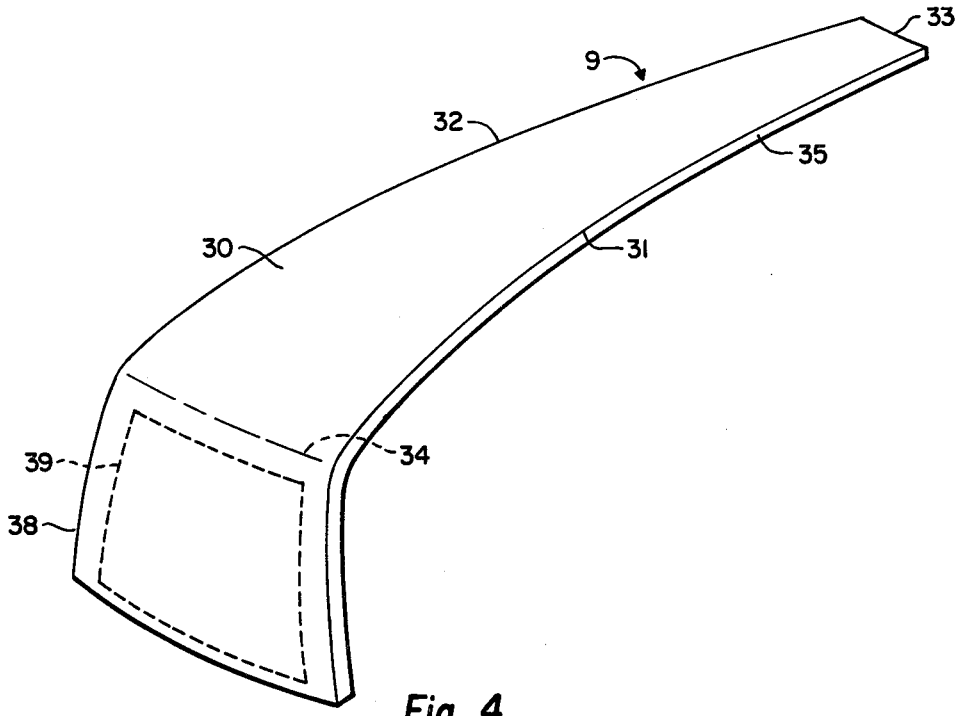
FIG. 4 is a perspective view showing an individual form according to the invention.
Figure 5:
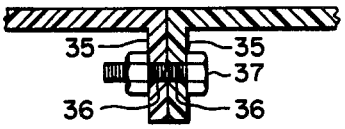
FIG. 5 shows the interconnections between the forms.
Figure 6:
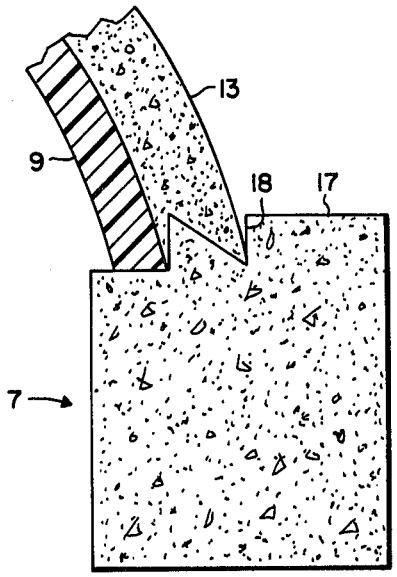
FIG. 6 shows the foundation support for the sidewall.

An individual form 9 onto which blown concrete is applied, is shown in FIG. 4. Each form comprises an upwardly inclined, triangular portion 30 having tapered sides 31, 32 an apex 33 and a base 34. Dependant edges 35 are provided from each side and have holes 36 therein for attachment by bolts 37 to an adjacent form; this is shown in FIG. 5. A quadrilateral shaped, upwardly inclined sidewall 38 is integrally formed along the base 34 and is curved to fit into the groove 18 of the foundation 7 as shown in FIG. 6. A section 39 of the sidewall, shown in dotted designation, may be removed to provide doorway and window openings, etc. Similarly, one or more triangular shaped portions 30 may be replaced with glass to provide a solar heat window 40. The sidewall either may have an outwardly convex curve as shown, or the sidewall may be concave 41 as shown in dotted designation. Both convex or concave portions may be replaced by doors, windows, masonry material, etc.

The forms 9 are preferably constructed of a reinforced resin such as fiberglass and may be further reinforced by peripheral metal strips, ribs, etc. so that the structural integrity of the form is maintained during poring and curing; the forms are, of course, reuseable a number of times. Normally, fiberglass is not recommended for reinforcement of concrete because of a chemical attack by the concrete on the fiberglass after an extended period of time (c.f. U.S. Pat. No. 3,462,521); however, removal of the forms after curing obviates this problem.

Forming the structure 11 in place is quite simple and involves aligning the forms within or adjacent the groove 18 of the foundation 7, bolting the form at its upper (apex) end to the metal collar 14 of the centerpost 8 at its underside, and bolting the edges 35 of the forms together to rigidify the structure. Lightweight concrete such as foam or gas concrete is then blown onto the forms through a wire mesh 42 at a uniform thickness of about 2–4 inches (preferably about 3 inches) and allowed to cure and harden; this is followed by removal of the forms. Finally, an interior and exterior coating of plaster may be applied for decorative purposes.

In its most inexpensive form, the resulting closed structure 11 provides an ellipsoid dome 12 and circular sidewall 13. While this structure is least expensive, other structural types may be produced by omitting one or more entire forms or parts thereof and replacing them with windows, doors, masonry, etc. This permits considerable variation in design without necessitating a change in the form design.

In addition to its functional applications and low cost of labor and materials, a considerable saving in concrete is obtained since no internal reinforcing posts are required other than the centerpost.

I claim:

1. A method for producing a house, building structure or the like comprising:
   - A. forming a cement foundation providing a centerpost and an outer retaining groove and wedge;
   - B. applying about 2–4 inches of foam or gas concrete onto forms supporting a wire reinforcement, curing the concrete and, removing the forms, support for the forms being provided solely between the centerpost and the retaining groove and wedge;
   - C. the forms comprising:
     - i. an elongate, positively curved upper portion defining triangular sides, an apex and a base; and,
     - ii. a lower, quadrilateral shaped sidewall portion, upwardly inclined and integrally formed with the upper portion along the base;
   - D. the forms being employed side-by-side to form a dome and sidewall of the structure, about 16–26 of the forms being so employed;
   - E. the structure being supported under compression solely between the centerpost and the retaining groove and wedge;
   - F. the structure providing an ellipsoid dome and integral circular sidewall, the dome having a radius/height ratio of about 1.15–2.5, a slope from base to apex of about 0.1–0.25, a sidewall to centerpost height of about 7–13 feet, a centerpost height of about 10–13 feet, and a dome radius of about 15–25 feet.

2. The method of claim 1 providing a height differential between the base at the upper portion of the dome and the centerpost of about 3 feet.

3. The method of claim 1 in which the forms are arranged to produce a closed curve.

4. The method of claim 1 in which the forms comprise a reinforced plastic.

5. The method of claim 1 in which the forms comprise a fiberglass reinforced plastic.

6. The method of claim 1 in which the forms are edge bolted together.

* * * * *